US007797775B2

(12) United States Patent
Miller

(10) Patent No.: US 7,797,775 B2
(45) Date of Patent: Sep. 21, 2010

(54) SLIDING MOBILITY ASSISTANCE DEVICE

(75) Inventor: F. Troy Miller, Logan, UT (US)

(73) Assignee: Stander, Inc., Logan, UT (US)

( * ) Notice: Subject to any disclaimer, the term of this patent is extended or adjusted under 35 U.S.C. 154(b) by 48 days.

(21) Appl. No.: 12/244,541

(22) Filed: Oct. 2, 2008

(65) Prior Publication Data

US 2009/0144899 A1 Jun. 11, 2009

Related U.S. Application Data

(60) Provisional application No. 60/976,988, filed on Oct. 2, 2007.

(51) Int. Cl.
*A47C 21/00* (2006.01)
*A47C 21/08* (2006.01)

(52) U.S. Cl. ..... 5/662; 5/424

(58) Field of Classification Search ..... 5/424, 5/428, 429, 662, 503.1, 658; 135/66; 297/411.23
See application file for complete search history.

(56) References Cited

U.S. PATENT DOCUMENTS

| | | | | |
|---|---|---|---|---|
| 2,159,323 | A | 7/1937 | John | |
| 2,722,017 | A | 11/1955 | Burst | |
| 3,179,957 | A | 4/1965 | Norton | |
| 3,289,223 | A | 12/1966 | Oja | |
| 3,553,746 | A * | 1/1971 | Seiger | 5/503.1 |
| 3,905,591 | A | 9/1975 | Schorr et al. | |
| 4,186,456 | A | 2/1980 | Huempfner | |
| 4,259,756 | A | 4/1981 | Pace | |
| 4,771,492 | A | 9/1988 | Paine et al. | |
| 5,129,116 | A | 7/1992 | Borders et al. | |
| 5,257,426 | A * | 11/1993 | Leoutsakos | 5/503.1 |
| 5,678,267 | A | 10/1997 | Kinder | |
| 6,058,531 | A | 5/2000 | Carroll | |
| 6,138,301 | A * | 10/2000 | Battiston | 5/81.1 R |
| 6,244,285 | B1 * | 6/2001 | Gamache | 135/67 |
| 6,401,280 | B1 * | 6/2002 | Baker | 5/662 |
| 6,618,877 | B2 | 9/2003 | Stephen | |
| 7,197,779 | B2 | 4/2007 | Shalikar | |
| 2004/0158923 | A1 | 8/2004 | Perez et al. | |
| 2007/0039100 | A1 | 2/2007 | Hensley et al. | |

* cited by examiner

*Primary Examiner*—Michael Trettel
(74) *Attorney, Agent, or Firm*—Stoel Rives LLP

(57) ABSTRACT

An mobility assistance device providing support for a user on a bed or similar furniture is disclosed. The mobility assistance device may include a support member that can be coupled to a piece of furniture and a support handle that is movable in a substantially vertical direction relative to the support member. The support handle is movable from an operating position to a stowed position. A locking mechanism may secure the support handle in the raised operating position.

24 Claims, 3 Drawing Sheets

SLIDING MOBILITY ASSISTANCE DEVICE

RELATED APPLICATIONS

This application claims the benefit under 35 U.S.C. §119 (e) of U.S. Provisional Patent Application Ser. No. 60/976,988, filed Oct. 2, 2007, and titled "Sliding Mobility Assistance Device," which is incorporated herein by reference.

TECHNICAL FIELD

The present disclosure relates generally to mobility assistance devices. More specifically, the present disclosure relates to assistance devices, such as bed rail devices, that can assist individuals in positioning themselves onto and securing themselves in beds or similar furniture.

BRIEF DESCRIPTION OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

DETAILED DESCRIPTION

It will be readily understood that the components of the embodiments as generally described and illustrated in the Figures herein could be arranged and designed in a wide variety of different configurations. Thus, the following more detailed description of various embodiments, as represented in the Figures, is not intended to limit the scope of the invention, as claimed, but is merely representative of various embodiments. While the various aspects of the embodiments are presented in drawings, the drawings are not necessarily drawn to scale unless specifically indicated.

The phrases "connected to," "coupled to" and "in communication with" refer to any form of interaction between two or more entities, including mechanical, electrical, magnetic, electromagnetic, fluid, and thermal interaction. Two components may be coupled to each other even though they are not in direct contact with each other. For example, two components may be coupled to each other through an intermediate component.

Figure 1:
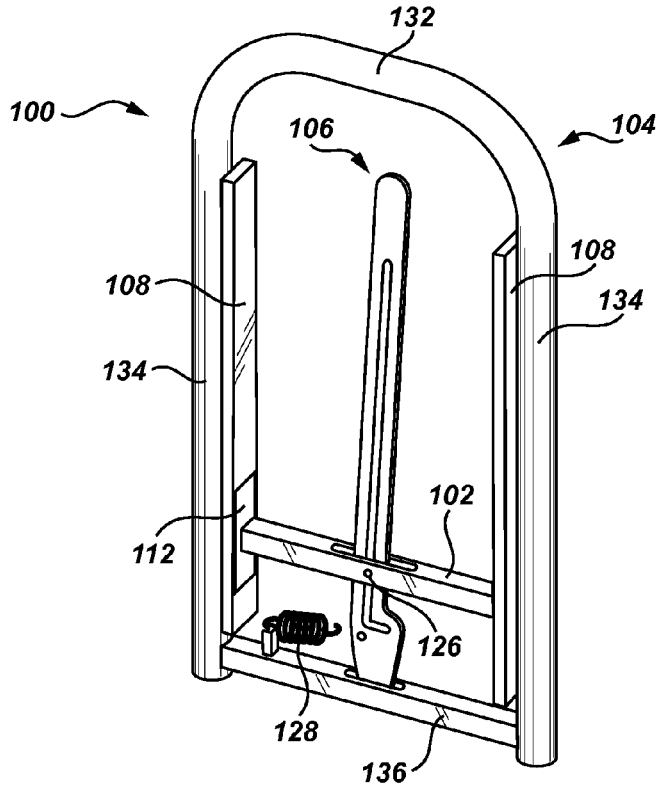
FIG. 1 is a perspective view of one embodiment of a mobility assistance device.

FIG. 1 represents one embodiment of a mobility assistance device 100 as shown from a perspective view. Mobility assistance devices are typically used to assist individuals with disabilities and/or other infirmities that may be incident to accidents, disease, age or similar causes. Mobility assistance devices are designed to help these individuals get into and out of reclining, sifting and/or prone positions on a bed or similar piece of furniture or object designed for one to sit, lie down or sleep on. Furthermore, bed rails also serve the function of securing an individual in a bed so that they do not fall out accidentally. The mobility assistance device 100 depicted may be used in various environments, including with a bed as a bed rail device.

Figure 2:
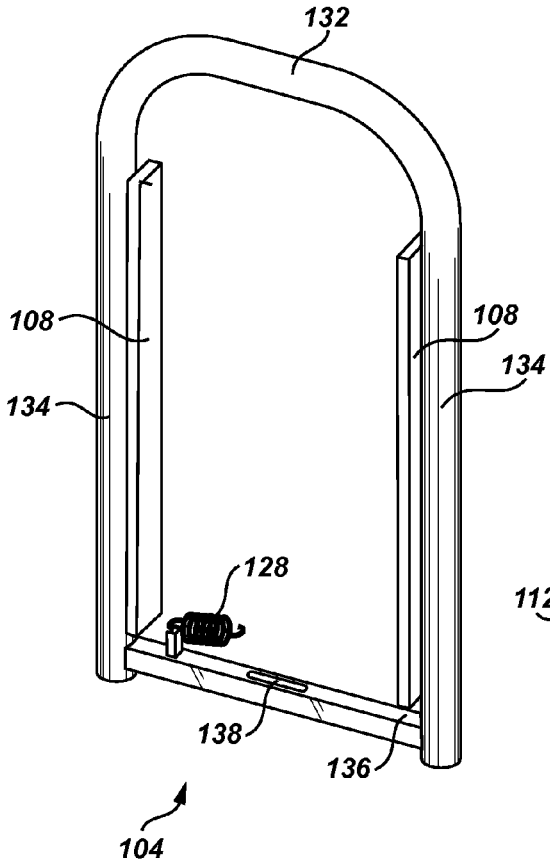
FIG. 2 is an exploded perspective view of the mobility assistance device of FIG. 1.
Figure 2:
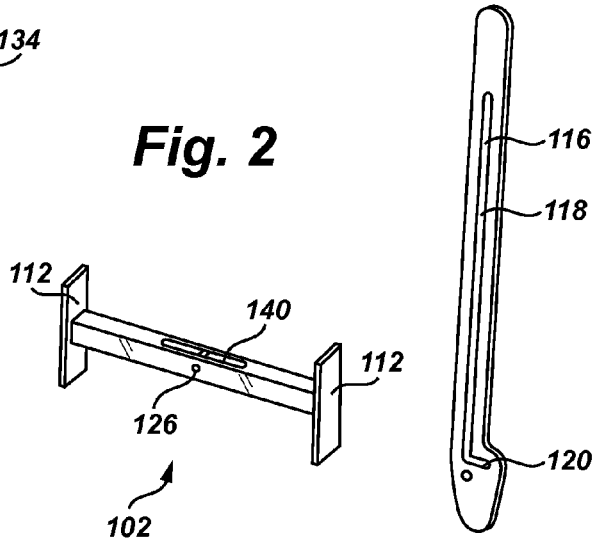

The assistance device 100 shown in FIGS. 1 and 2 may include a support member 102, a support handle 104, and a locking member 106. In one embodiment, the support member 102 of the assistance device 100 is designed to be coupled to a bed, or a couch, or similar furniture. In one embodiment, the support member 102 is coupled to a bed frame, such as through a clamp. In another embodiment, the support member 102 may be coupled to a base member that fits between a mattress and box spring, such as those illustrated in U.S. Pat. No. 7,032,265 to Miller.

The support handle 104 is movable from a raised operating position to a lowered stowed position. Once the support member 102 is coupled to the bed or similar furniture as described herein, the support handle 104 provides support for an individual during ingress and egress to and from the bed or similar furniture. When the support handle 104 is in the raised operating position, the user may grip the support handle 104 at any point and lower himself onto the bed. Likewise, the user may pull on the support handle 104 to get himself out of the bed. In the lowered stowed position, the support handle 104 no longer obstructs the portion of the bedside that is typically restricted by the support handle 104 in its raised positions. However, in some embodiments the upper portion of support handle 104 in the lowered stowed position may still provide support to a user when getting into or out of bed. The support member 102 provides support for the support handle 104 when a user pulls or pushes thereon.

According to the embodiment depicted in FIGS. 1 and 2, the support member 102 may include engaging pieces 112 that are disposed at the ends of the support member 102. However, in alternative embodiments, the support member 102 may include more than two engaging pieces at the ends, such as when there exists a plurality of support members. Those having skill in the art with the aid of present disclosure will recognize that various configurations and designs of the support member may be used to provide the necessary support for the support handle 104, including, but not limited to, a support member in the shape of a rectangular crossbar, a support member in the shape of an arc, or a support member having a plurality of crossbars.

According to the embodiment depicted in FIGS. 1 and 2, the support handle 104 of the mobility assistance device 100 may include a rail support bar 132 for providing support for an individual during ingress and egress to and from the bed or similar furniture. The rail support bar 132 may be straight, curved, or a shape with similar functionality. Those having skill in the art with the aid of present disclosure will recognize that various shapes and designs of the rail support bar may be used to provide support to the user, including, but not limited to, a U-shaped rail support bar, or a rectangular-shaped rail support bar having various cross-sectional shapes such as circular, elliptical, triangular, square or rectangular. In alternative embodiments, the support handle 104 may include more than one rail support bar to provide necessary support for the user.

Once the support member 102 is coupled to the bed as described herein, the user may grip the rail support bar 132 at any point and lower himself onto the bed. The user may also maintain contact with the rail support bar 132 in order to position himself on the bed. Likewise, if the user desires to get out of the bed, the user may pull on the support bar 132 to swing his legs off the bed. Once in this position, the user may pull on the support bar 132 in order to rise into a standing position. While moving to a standing position, the support bar 132 may assist the user in establishing his balance. In some situations, the user may want to lower the support handle 104 to get in and out of the bed. The support handle 104 also may also act as retention device to keep people from falling off the bed.

The support handle 104 may further include side bars 134 and tracks 108 that are attached to the side bar 134 such that the tracks 108 slidably engage the engaging pieces 112 of the support member 102 to facilitate sliding movement between the support handle 104 and the support member 102. In one embodiment, the support handle 104 comprises a first track 108 which slidably engages an engaging piece 112 of the support member 102. The support handle 104 may further comprise a second track 108 which may be positioned opposed to the first track 108 and slidably engages another engaging piece 112 of the support member 102. In another embodiment, the side bars 134 may function as the "tracks" by having tracks integrally formed within side bars, or alternatively shaped to function as a track. This alternative embodiment would eliminate the extra cost associated with attaching separate tracks to the side bars 134. Those having skill in the art with the aid of the present disclosure will recognize that various designs and shapes of the tracks 108 may be used, including, but not limited to, channel-shaped tracks, or planar tracks.

Figure 3:
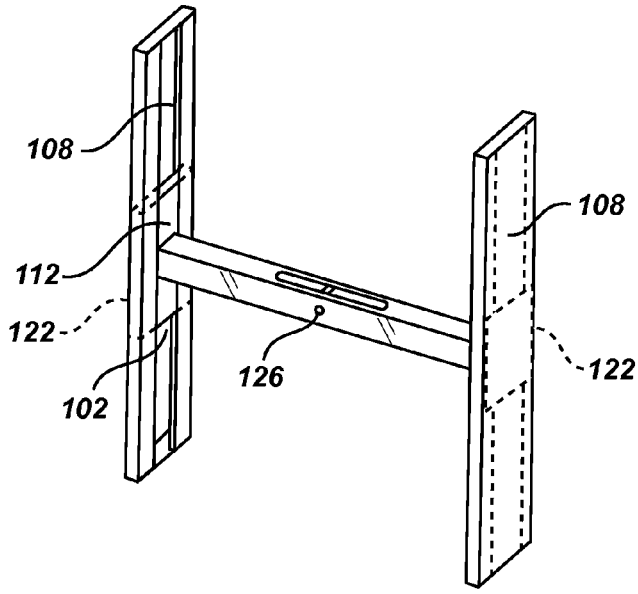
FIG. 3 is a partially cut-away perspective view of the mobility assistance device of FIG. 1.

As shown in FIG. 3, the engaging pieces 112 of one embodiment of the support member 102 may also include flanges 122 or alternative attaching members. In such an embodiment, the tracks 108 on the support handle 104 may include a projection against which the flanges 122 abut to prevent the separation of the engaging pieces 112 from the tracks 108 on the support handle 104.

Referring back to FIGS. 1 and 2, the support handle 104 is movable along the tracks 108 of the support handle 104 in a substantial perpendicular direction relative to the support member 102. In the embodiment of FIG. 1, the support handle 104 is movable in a vertical direction. The engaging pieces 112 of the support member 102 are slidably movable along a length of the tracks 108. When a user desires to lower the support handle 104 from a raised position, the user can push the support handle 104 downward in a substantial perpendicular direction relative to the support member 102. When the engaging pieces 112 abut the upper ends of the tracks 108, the support handle 104 is no longer movable downward in the perpendicular direction toward the support member 102.

When the engaging pieces 112 abut the lower ends of the tracks 108, the support handle 104 is no longer movable upward in the perpendicular direction away from the support member 102. In another embodiment, the support handle 104 is movable along the length of the tracks 108 in a substantially vertical direction relative to the support member 102, but not necessarily perpendicular, such as when the support member extends in a diagonal direction. In another embodiment, the support handle is movable in a substantially horizontal direction. Such embodiments will be described in greater detail hereinafter.

Referring still to FIGS. 1 and 2, the mobility device 100 may further include a ball bearing or bushing mechanism located at the interface of the tracks 108 and the support member 102 to facilitate sliding movement between the support member 102 and the support handle 104. In another embodiment, the assistance device 100 may include a rail sliding mechanism comprising a wheel that engages or otherwise moves within the tracks 108 on the support handle 104 to facilitate sliding movement between the support handle 104 and the support member 102. Alternatively, the assistance device 100 may include a rail mechanism comprising a plurality of wheels that engages or otherwise moves within the tracks 108. In yet another embodiment, the assistance device 100 may include a rail sliding mechanism comprising a track that engages or otherwise moves within the tracks 108 on the support handle 104 to facilitate sliding movement between the support handle 104 and the support member 102. Further still, the sliding mechanism may occur via gears, such as a rack and pinion arrangement. Alternative sliding rail mechanisms may be apparent to those having skill in the art with the aid of the present disclosure. For example, a tapered roller bearing mechanism or a needle roller bearing mechanism may also be used to facilitate sliding movement between the support member 102 and the support handle 104. Additionally, in an embodiment where the side bars 134 serve as tracks, a larger diameter tube comprising bushings may be used to allow the support handle 104 to slide relative to the support member 102.

The mobility assistance device 100 may include a locking member 106 to lock the support handle 104 in the raised operating position. In one embodiment, the locking member 106 may include a channel 116 that includes a first elongate portion 118 extending along a majority of a length of the locking member 106 in a substantially parallel direction relative to the side bars 134 of the support handle 104 and a second portion 120 substantially perpendicular to the first elongate portion 118. According to one embodiment, the locking member 106 is slidably coupled to the support member 102. In the embodiment depicted, the support member 102 may comprise an opening portion 140 through which the locking member 106 passes. Alternatively, the locking member 106 may be slidably coupled to the support member 102 through an element projecting out of the surface of the support member 102. The locking member 106 may also be coupled to the support handle 104, so that the locking member 106 may be concurrently movable along with the support handle 104 in the vertical direction relative to the support member 102. In one embodiment, the support handle 104 may include a lower bar 136 that includes an opening portion 138 through which the locking member 106 is hingedly connectable with the support handle 104. Alternatively, the support handle 104 may comprise more than one lower bar that includes an opening portion through which the locking member 106 is hingedly connected with the support handle 104.

The support member 102 may also include a projecting element 126 that extends through the channel 116 in the locking member 106. In one embodiment, the projecting element 126 is movable along the length of the channel 116 and lodgable in the second portion 120 of the channel 116. In such an embodiment, the projecting element 126 is lodgable in the second portion 120 but not movable in the vertical direction relative to the support member 102 within the second portion 120. As a result, when the projecting element 126 is lodged in the second portion 120 of the channel 116, the support handle 104 is no longer movable in a vertical direction relative to the support member 102, and thus the support handle 104 is locked in the operating position. When the projecting element 126 is dislodged from the second portion 120 of the channel 116, the support handle 104 may slide to a lowered position as will be described in greater detail hereinafter.

In alternative embodiments, the locking member 106 may comprise two, or more than two, portions 120 that are substantially perpendicular to the elongate portion 118. In such embodiments, the projecting element 126 is lodgable in at least one of the second portions 120, which in turn locks the support handle 104 in the operating position at various heights. Once the projecting element 126 is lodged in one of the second portions 120 of the channel 116, the support handle 104 is locked in a position in which the support handle 104 is no longer movable in a vertical direction relative to the support member 102. Consequently, the support handle 104 is securable in one, or more than one, locking position.

Figure 6:
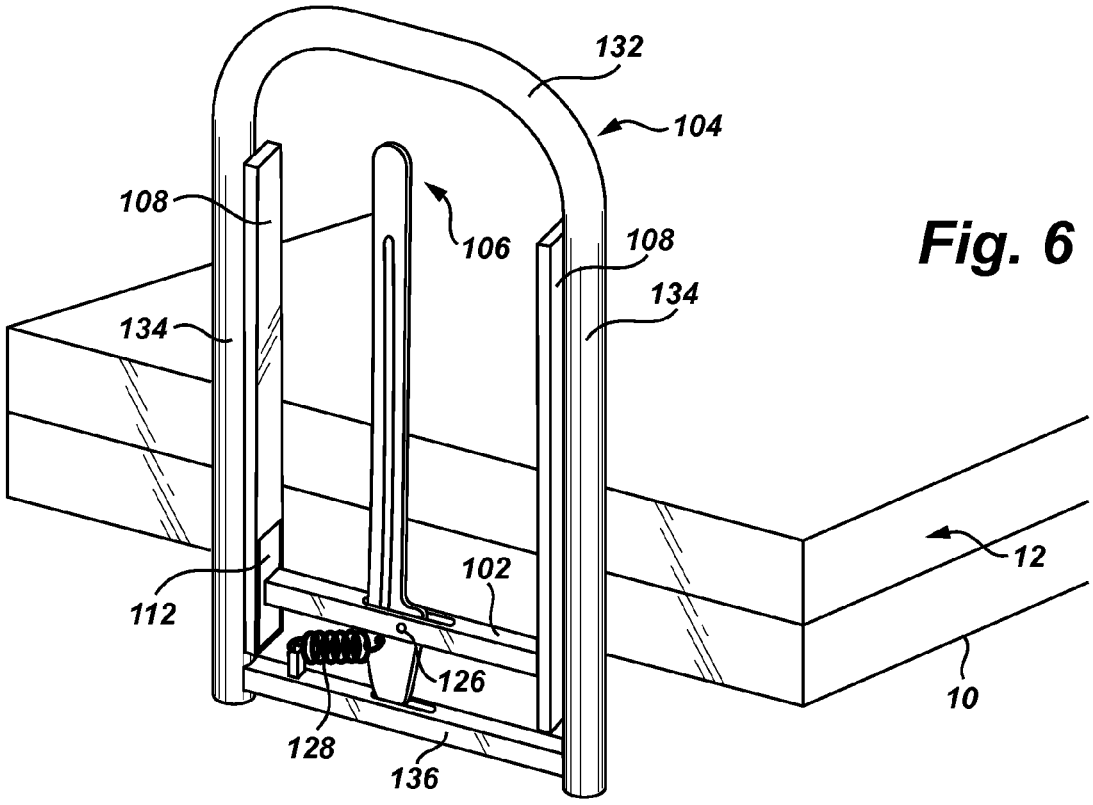
FIG. 6 is a perspective view of the mobility assistance device of FIG. 1 in a raised operating position.

The support handle 104 may further include a biasing element 128 interconnecting the support handle 104 to the locking member 106. The biasing member 128 may be a coil spring, a strap of rubber, or device with similar functionality. In one embodiment, the locking member 106 is biased by the biasing member 128 in a direction opposite to the direction to which the second portion 120 of the channel 116 in the locking member 106 extends. When a user pulls the support handle 104 upward and raises the support handle 104 to the operating position as depicted in FIG. 6, the locking member 106 may be biased by the biasing member 128 to cause the locking member 106 to hingedly move, which causes the projecting element 126 to lodge in the second portion 120 of the channel 116 in the locking member 106. As a result, the support handle 104 is no longer movable in a vertical direction relative to the support member 102, and thus the support handle 104 is locked in the operating position.

In an alternative embodiment, the support handle may be coupled to a counterbalance assembly. A counterbalance assembly may allow the weight of the handle to be lifted in the perpendicular direction relative to the stationary support member with less effort. Exemplary counterbalance assemblies may include a spring, bungee cord, weight and cable, etc.

Figure 4:
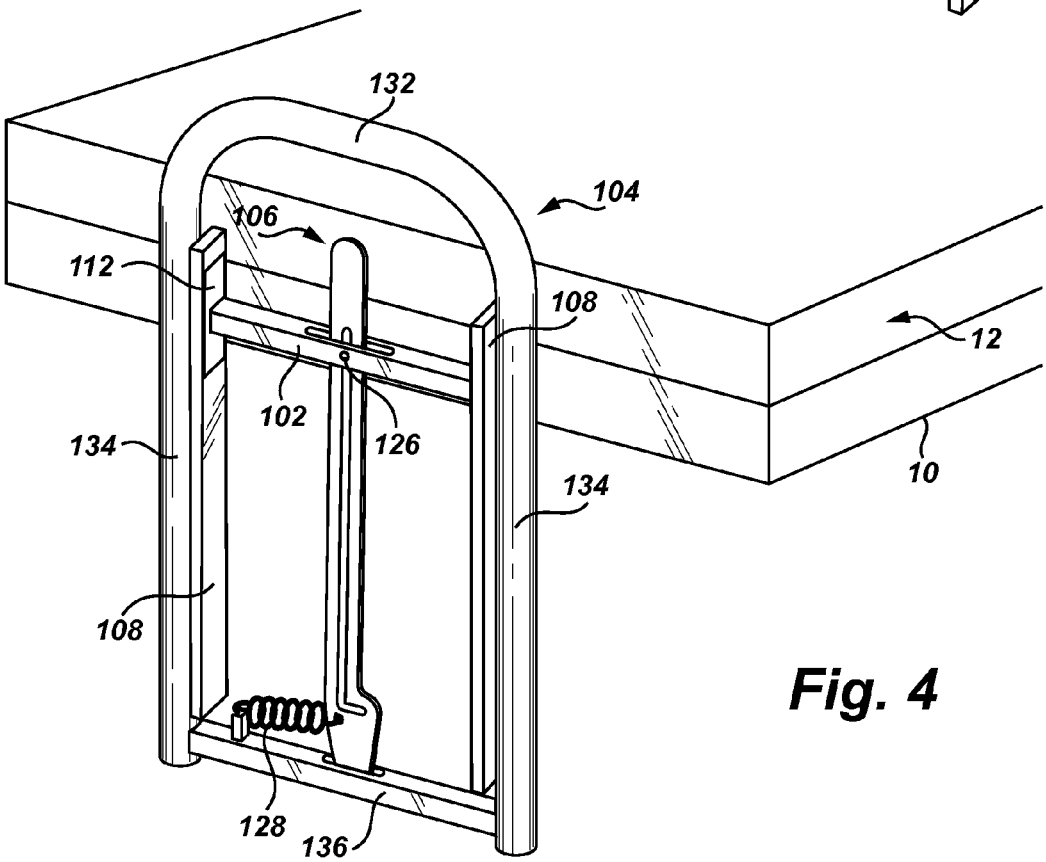
FIG. 4 is a perspective view of the mobility assistance device of FIG. 1, as used adjacent a bed, with its support handle in a lowered, stowed position.
Figure 5:
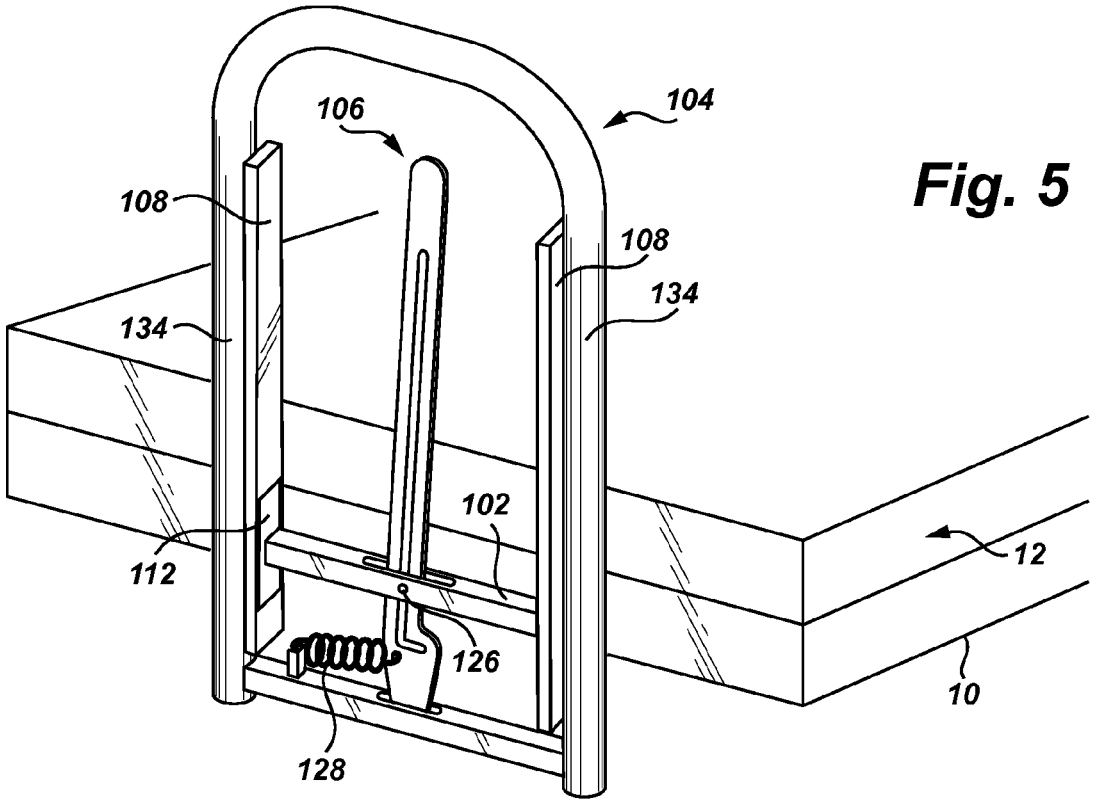
FIG. 5 is a perspective view of the mobility assistance device of FIG. 1 as its support handle is being raised to an operating position.

FIG. 4 represents the mobility assistance device 100 of FIG. 1 adjacent a bed 10, with the support handle 104 in a lowered stowed position. In such a lowered stowed position, the support handle 104 no longer obstructs the portion of the bedside that is typically restricted by the support handle 104 in its raised positions as illustrated in FIGS. 5 and 6. In the embodiment depicted, the locking member 106 is slidably coupled with the support member 102. When the support handle 104 is in the lowered stowed position, the engaging pieces 112 on the support member 102 may abut the upper ends of the tracks 108 on the support handle 104 so that the support handle 104 is no longer movable downward in the vertical direction toward the support member 102.

Additionally or alternatively, the projecting element 126 may abut the upper end of the first elongate portion 118 of the channel 116 in the lower, stowed position. Alternatively, the projecting element 126 may be located between the upper end of the first elongate portion 118 of the channel 116 and the conjunction of the first elongate portion 118 and the second portion 120 of the channel 116 within the first elongate portion 118.

FIG. 5 illustrates the mobility assistance device 100 of FIG. 1 from a perspective view, with the support handle 104 raised in transition from the lowered position to the raised operating position. In such a transitional position, the engaging pieces 112 engage the tracks 108 on the support handle 104 at a position located between the upper ends of the tracks 108 and the lower ends of the tracks 108. The support handle 104 is slidably movable upward in the vertical direction away from the support member 102. The projecting element 126 of the support member 102 is situated within the first elongate portion 118 of the channel 116 in the locking member 106. In one embodiment, the projecting element 126 may be located between the upper ends of the first elongate portion 118 of the channel 116 and the conjunction of the first elongate portion 118 and the second portion 120 of the channel 116. In another embodiment, the locking member 106 is coupled to the support handle 104 through the biasing element 128 and the lower bar 136, and thus the locking member 106 can move concurrently with the support handle 104 in the substantially vertical direction relative to the support member 102.

FIG. 6 illustrates the mobility assistance device 100 of FIG. 1 from a perspective view, with the support handle 104 in a raised operating position. The assistance device 100 is illustrated in its operational configuration where the projecting element 126 on the support member 102 is lodged in the second portion 120 of the channel 116 in the locking member 106. In such a raised operating position, the locking member 106 may be biased by the biasing member 128 to cause the locking member 106 to hingedly move toward the biasing member, which causes the projecting element 126 to lodge in the second portion 120 of the channel 116. Consequently, the support handle 104 is not movable in the vertical direction relative to the support member 102 without activation of the locking member 106 by a user, and thus the support handle 104 is locked in the raised operating position. In the raised operating position, the rail support bar 132 of the support handle 104 extends above the mattress 12 to provide support for a user on the bed 10 or for a user's ingress and egress to and from the bed 10.

When a user desires to lower the support handle 104 of the assistance device 100 from the locked operating position, a user may pull, push, pivot or otherwise move the locking member 106 to cause the projecting element 126 to move out of the second portion 120 of the channel 116 in the locking member 106 and into the first portion 118 of the channel 116. The support handle 104 may then be unlocked and the user can push the support handle 104 downward toward the direction of the support member 102. The support handle 104 may travel downward until the engaging pieces 112 abut the upper ends of the tracks 108 on the support handle 104 or the projecting element 126 abuts the top of the first portion 118 of channel 116.

In an alternative embodiment (not shown) the mobility device may include a support member in the shape of a dual crossbar to which the locking member is slidably coupled. Such support member may include a center block and arms that extend diagonally from the center block toward the tracks on the support handle. The arms may be integrally formed with the center block, or alternatively, may be separate pieces coupled to the center block. The support member may include engaging pieces at the ends of each arm, which slidably engage the tracks on the support handle. In such an embodiment, the support handle is movable in a substantial vertical direction relative to the support member.

Like the embodiment depicted in the accompanying Figures, the locking member of the alternative embodiment described herein may be slidably coupled to the support member. The locking member may include a channel that includes a first elongate portion extending along a majority of a length of the locking member and a second portion substantially perpendicular to the first elongate portion. The center block of the support member may comprise an opening through which the locking member passes. Alternatively, the locking member may be slidably coupled to the support member through an element projecting out of the surface of the support member. Like the embodiment shown in the accompanying Figures, the locking member may also be hingedly coupled to a lower bar of support handle, so that the locking member may be concurrently movable along with the support handle in the vertical direction.

In yet another alternative embodiment, one of the tracks on the support handle may be positioned above the other track, such that the support handle slides in a horizontal direction. In such an embodiment, the support member may include engaging pieces that engage the tracks. The engaging pieces may optionally include flanges to prevent the separation of the engaging pieces from the tracks. The support handle is movable from an operating position to a stowed position in a substantially horizontal direction.

While specific embodiments of mobility assistance devices have been illustrated and described, it is to be understood that the invention claimed hereinafter is not limited to the precise configuration and components disclosed. Various modifications, changes, and variations apparent to those of skill in the art may be made in the arrangement, operation, and details of the methods and systems disclosed.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art that changes may be made to the details of the above-described embodiments without departing from the underlying principles of the invention as claimed hereinafter. In other words, various modifications and improvements of the embodiments specifically disclosed in the description above are within the scope of the appended claims.

What is claimed is:

1. A mobility assistance device, comprising:

a support member configured to be coupled to a piece of furniture; and a support handle to provide support to a user, the support handle comprising a track which slidably engages the support member;

wherein the support handle is movable in a substantially vertical direction relative to the support member;

wherein the support member comprises a first engaging piece that slidably engages the track on the support handle, the first engaging piece comprising a flange to prevent the separation of the first engaging piece from the track.

2. The assistance device of claim 1, wherein the vertical direction is substantially perpendicular relative to the support member.

3. The assistance device of claim 1, wherein the support handle is movable from a raised operating position to a lowered stowed position.

4. The assistance device of claim 3, wherein the support handle is securable in a position between the raised operating position and the lowered stowed position.

5. The assistance device of claim 1, wherein the support handle comprises a second track which slidably engages the support member and the support member comprises first and second engaging pieces; the first engaging piece disposed at one end of the support member and comprising an attaching member to prevent the separation of the first engaging piece from the first track, and the second engaging piece disposed at the other end of the support member and comprising an attaching member to prevent the separation of the second engaging piece from the second track.

6. The assistance device of claim 1, further comprising a bearing mechanism located at the interface of the track and the support member.

7. The assistance device of claim 1, further comprising a wheel that engages the track on the support handle to facilitate sliding movement between the support handle and the support member.

8. The assistance device of claim 1, further comprising:

a locking mechanism to secure the support handle in a raised operating position, the locking mechanism comprising a channel that includes a first elongate portion extending in a substantially vertical direction relative to the support member and a second portion substantially perpendicular to the first portion.

9. A mobility assistance device, comprising:

a support member configured to be coupled to a piece of furniture;

a support handle to provide support to a user, the support handle comprising a pair of tracks which slidably engage the support member, the support handle is movable in a substantially vertical direction between a raised operating position and a lowered stowed position; and a locking member to prevent movement of the support handle relative to the support member when the support handle is in the raised operating position, the locking member is slidably coupled to the support member;

wherein the locking member is coupled to the support handle and is concurrently movable along with the support handle in the vertical direction.

10. The assistance device of claim 9, wherein the locking member comprises a channel including a first elongate portion extending along a majority of a length of the locking member and a second portion substantially perpendicular to the first portion.

11. The assistance device of claim 10, wherein the support member comprises a projecting element that extends through the channel in the locking member, the projecting element is lodgable in the second portion of the channel in the locking member to prevent movement of the support handle relative to the support member when the support handle is in the raised operating position.

12. The assistance device of claim 11, wherein the support handle comprises a biasing element that couples the support handle to the locking member, the locking member is biased by the biasing element to facilitate lodging of the projecting element of the support member in the second portion of the channel in the locking member to secure the support handle in the raised operating position.

13. The assistance device of claim 12, wherein the locking member is configured to be movable by the user against the bias of the biasing element to release the support handle from the raised operating position to the lower stowed position.

14. A mobility assistance device, comprising:

a support member configured to be coupled to a piece of furniture;

a support handle configured to support a user, the support handle comprising a first track and a second track which slidably engage the support member;

wherein the support handle is movable in a substantially perpendicular direction relative to the support member;

wherein the first track on the support handle is positioned above the second track and the support member comprises first and second engaging pieces to engage the first and second tracks respectively; the first engaging piece comprising an attaching member to prevent the separation of the first engaging piece from the first track; and the second engaging piece comprising an attaching member to prevent the separation of the second engaging piece from the second track.

15. The assistance device of claim 14, wherein the support handle is movable from an operating position to a stowed position in a substantially horizontal direction.

16. The assistance device of claim 14, further comprising:

a locking member to prevent the movement of the support handle relative to the support member when the support handle is in an operating position, wherein the locking member is hingedly coupled to the support handle and is movable along with the support handle in a substantially perpendicular direction relative to the support member.

17. The assistance device of claim 16, wherein the locking member comprises a channel including a first elongate portion extending along a majority of a length of the locking member and a second portion substantially perpendicular to the first portion, the support member comprises a projecting element that extends through the channel in the locking member; the projecting element is lodgable in the second portion of the channel in the locking member to prevent movement of the support handle relative to the support member when the support handle is in the operating position.

18. The assistance device of claim 17, wherein the support handle comprises a biasing element that couples the support handle to the locking member, the locking member is biased by the biasing element to facilitate lodging of the projecting element of the support member in the second portion of the channel in the locking member to secure the support handle in the operating position.

19. The assistance device of claim 17, wherein the locking member comprises a third portion substantially perpendicular to the first portion, the third portion positioned above the second portion, such that the projecting element is lodgable in the third portion of the channel to prevent movement of the support handle relative to the support member when the support handle is in a position lowered from the operating position.

20. The assistance device of claim 14, wherein the support handle is movable from a stowed position to an operating position in a substantially vertical direction.

21. A mobility assistance device configured to be coupled to a piece of furniture and operable to provide support to a user, the mobility assistance device comprising:

a support member configured to couple the mobility assistance device to the piece of furniture;

a moveable component, the moveable component moveable in a direction substantially perpendicular with respect to the support member;

a support handle to provide support to the user, the support handle coupled to the moveable component; and a first track, a second track, a first engaging piece, and a second engaging piece;

wherein the moveable component is coupled to the first and second engaging pieces, and wherein the first and second engaging pieces slidably engage the first and second tracks respectively.

22. The mobility assistance device of claim 21, wherein the support member comprises a base, the base configured to be disposed between a box spring and a mattress of a bed.

23. The mobility assistance device of claim 21, wherein the support handle is integrated with the moveable component, such that the support handle is movable with the movable component.

24. The mobility assistance device of claim 21, further comprising a stop limiting the movement of the moveable component.

* * * * *

UNITED STATES PATENT AND TRADEMARK OFFICE

CERTIFICATE OF CORRECTION

PATENT NO. : 7,797,775 B2
APPLICATION NO. : 12/244541
DATED : September 21, 2010
INVENTOR(S) : Troy Miller It is certified that error appears in the above-identified patent and that said Letters Patent is hereby corrected as shown below:

On the Title Page, Item (57) Abstract, Line 1 reads, "An mobility assistance device..." which should read, "A mobility assistance device..."

Column 1, Line 67 reads, "...sifting and/or prone positions on a bed..." which should read, "...sitting and/or prone positions on a bed..."

Column 3, Lines 6-7 read, "The support handle 104 also may also act as retention device..." which should read, "The support handle 104 may also act as a retention device..."

Signed and Sealed this
Eighteenth Day of December, 2012

David J. Kappos

David J. Kappos
*Director of the United States Patent and Trademark Office*